US006866035B2

(12) United States Patent
Haemerle

(10) Patent No.: US 6,866,035 B2
(45) Date of Patent: Mar. 15, 2005

(54) FREESTANDING PORTABLE SPLATTER SHIELD

(76) Inventor: Richard R. Haemerle, 349 W. Wind Estates La., Valley Park, MO (US) 63088

( * ) Notice: Subject to any disclaimer, the term of this patent is extended or adjusted under 35 U.S.C. 154(b) by 0 days.

(21) Appl. No.: 10/248,951

(22) Filed: Mar. 5, 2003

(65) Prior Publication Data

US 2004/0173201 A1 Sep. 9, 2004

(51) Int. Cl.[7] ..... F24C 15/10
(52) U.S. Cl. ..... 126/214 D; 211/42
(58) Field of Search ..... 126/214 D, 211, 126/42, 214 R

(56) References Cited

U.S. PATENT DOCUMENTS

| | | | | | |
|---|---|---|---|---|---|
| 2,582,373 | A | * | 1/1952 | Cordrey | 126/299 C |
| 2,591,786 | A | * | 4/1952 | Cronheim | 160/135 |
| 2,699,162 | A | * | 1/1955 | Nazzaro | 126/211 |
| 2,772,414 | A | * | 11/1956 | Baker, Jr. | 126/214 R |
| 2,879,763 | A | * | 3/1959 | Long | 126/340 |
| 3,513,826 | A | * | 5/1970 | Hellmuth | 126/211 |
| 4,037,581 | A | | 7/1977 | Trifiletti | |
| 4,150,664 | A | | 4/1979 | Trombatore | |
| 4,157,705 | A | * | 6/1979 | Caan | 126/211 |
| 4,237,856 | A | | 12/1980 | Trombatore | |
| 4,422,441 | A | | 12/1983 | Schoepe | |
| 4,770,091 | A | * | 9/1988 | Vaughn | 99/421 H |
| 4,836,281 | A | * | 6/1989 | Robin et al. | 166/270.1 |
| D303,909 | S | * | 10/1989 | Stankus et al. | D7/406 |
| 4,981,086 | A | * | 1/1991 | Barca et al. | 109/49.5 |
| 5,076,255 | A | * | 12/1991 | Harrison | 126/42 |
| 5,231,707 | A | * | 8/1993 | Ashley et al. | 4/557 |
| 5,351,673 | A | * | 10/1994 | Somerton | 126/214 D |
| 5,357,943 | A | | 10/1994 | Edgerton | |
| 5,372,174 | A | * | 12/1994 | Wilke | 160/135 |
| 5,438,974 | A | | 8/1995 | Maldonado | |
| 5,450,840 | A | | 9/1995 | Kozdas | |
| 5,546,928 | A | | 8/1996 | Lewis | |
| 5,615,667 | A | | 4/1997 | Seeley et al. | |
| 5,758,636 | A | * | 6/1998 | Butrimas et al. | 126/211 |
| 5,813,396 | A | | 9/1998 | Bessette | |
| 5,842,464 | A | | 12/1998 | Koch | |
| 6,371,105 | B1 | | 4/2002 | Merritt | |

* cited by examiner

*Primary Examiner*—Alfred Basichas
(74) *Attorney, Agent, or Firm*—Blackwell Sanders Peper Martin LLP

(57) ABSTRACT

A freestanding splatter shield for use in kitchens and other food processing work areas including a central panel and first and second end panels pivotally attached to the respective opposite end portions of the central panel. The first and second end panels are selectively positionable at a plurality of different angular orientations relative to the central panel to accommodate different work areas and are foldable or collapsible into a compact storage position wherein the first and second end panels lie substantially parallel to the central panel in overlaying relationship thereto. In addition, the present splatter shield may include at least one extension member operatively associated with the central panel for selectively increasing and decreasing the overall length of the central panel.

18 Claims, 6 Drawing Sheets

FREESTANDING PORTABLE SPLATTER SHIELD

BACKGROUND OF INVENTION

The present invention relates generally to splatter guards and shield assemblies and, more particularly, to an all purpose portable, freestanding, and adjustable splatter shield for use in kitchens and other areas.

Splatter shields for use in kitchens are well known. They are typically constructed to be used on or about a stovetop and attach permanently or semi-permanently to the stove. An example of such a splatter shield can be found in U.S. Pat. No. 5,351,673. This device is referred to as a spatter guard for use with a recreational vehicle (RV) stove. It attaches to a hinged cover that overlies the burners on the stove and can only be used when the burner cover is in an elevated position exposing the burners for use. The spatter guard includes two wings each positionable at opposite sides of the stove, each wing being attachable to an opposite end of the burner cover. Such a spatter guard is dedicated for use with a stove having a burner cover and on its own is not freestanding.

Other forms of known spatter guards attach to the front of a stove, either permanently or semi-permanently, and are used to shield a person from forward splattering and/or accidental contact with the burners. For example, U.S. Pat. No. 5,813,396 discloses such a guard device which attaches to the front of the stove and extends above the range top surface a sufficient distance to deflect hot food particles emitted during cooking so as to prevent such food particles from being projected outwardly beyond the front plane of the stove. This device does not protect the stove or kitchen area from spattering to the sides or rear of the stove or other areas.

U.S. Pat. No. 4,237,856 discloses a pair of splatter screens which are built into or are attachable to the sides of a stove adjacent the burners. The screens are retractable into the frame associated with the stove but do not protect a spattering to the rear or other locations relative to the stovetop.

Another form of spatter guard is found in U.S. Pat. No. 6,371,105. This device involves the use of burner covers, a stove control cover and a rear panel that is foldable to cover the rear burners. This shield is hingedly attachable to a stove via a frame that is mounted to the stove top.

Another splatter shield is disclosed in U.S. Pat. No. 4,422,441. This splatter shield is collapsible and includes a series of pleated metal foil panels which collapse flat in accordion fashion for storage. While portable and usable at various locations, the accordion style pleated shield is awkward, difficult to manipulate and maneuver, difficult to position in certain work areas, and difficult to clean and maintain sanitary because of its pleated construction. Also, importantly, the end panels are not angularly adjustable relative to the central back panel.

Splattering or spattering can occur at various locations in the kitchen when working, particularly in and around the stove area. Stoves however come in various shapes and sizes and can be located at various positions in a kitchen. This makes it difficult to provide for a somewhat universally adaptable splatter shield. None of the above-described splatter shields are readily adaptable for use with the different and varying sizes and styles of stoves available today. Further, they are not adaptable for use in other locations within a kitchen, for example, at a sink or on a countertop where food is being prepared and processed. Further, they are not adaptable for use with portable cooking devices, for example, an electric skillet, wok, food processor and so forth.

Another problem with the above-described splatter shields is that they are not easily foldable and adaptable for easy storing as a complete unit nor are they adjustable to accommodate varying appliances and cooking or food preparation locations. Typically, storage space in a kitchen is at a premium and any device needs to be easily storable without taking up unnecessary storage space.

Thus, there is a need for an improved splatter shield for use in kitchens and other food processing areas.

SUMMARY OF INVENTION

The present invention relates to a splatter shield which includes a central panel and two end panels that are selectively foldable in an overlying relationship to the central panel for storage and are positionable at a multitude of different angular orientations extending outwardly from the central panel for use in a freestanding manner. A stove or other kitchen appliance such as a wok, electric skillet, mixer and so forth may be positioned in the space between the end panels and central panel providing a shield on three sides of a work area. The central panel may comprise a wall member having extension members associated therewith which are movably mounted thereto for adjusting the length of the central panel in a selective manner. The end panels are hingedly connected to the central panel or to the extension members and preferably the hinged connection is accomplished through the use of integral hinge members such as flexible non-mechanical anamorphic type hinges, although other hinge elements and hinge arrangements would likewise work equally as well. The hinge members may be constructed such that the two end panels will lie generally flat and parallel to the central panel in an overlaying relationship when the end panels are folded into their storage position. Retention members may also be provided to fix the moveable extension members in a selected position relative to the central panel. The splatter shield is preferably made of a molded polymeric material for lightness in weight, easy cleaning and imperviousness to degradation by cleaners and food products.

The present splatter shield therefore represents an all purpose kitchen splatter type barrier which can be used in any work location involving the preparation of food, cooking, or even other applications such as for use in preventing splatter associated with stove tops, around sink areas, while using a multitude of different types of electrical appliances such as cooking with electric skillets, woks, griddles or portable grills, preparing food with food processors and electric mixers, preparing foods on countertops and cutting boards, and many additional applications. The present splatter shield is expandable and adjustable to fit any stove top or other working location and its end panels are likewise angularly adjustable to again accommodate the size and space associated with the particular working location. In its preferred embodiment, the present splatter shield may be constructed of materials which are fire and heat resistant, bacteria resilient, non-porous and non-absorbent, and it may include non-stick surfaces. The present splatter shield is portable, freestanding and lightweight so that it can be easily moved from one work location to another such as for use behind a sink for preparing messy foods or cleaning pots and pans or the sink area, for use on countertops for appliances that splatter during the cooking process, and for use with electric appliances such as woks, stir fries and grills that produce hot grease or splatter during the cooking process. In addition, because of its foldability, the present splatter shield can be quickly and easily removed from the work area and easily folded into its storage position for compact storage when not in use.

DETAILED DESCRIPTION

Figure 1:
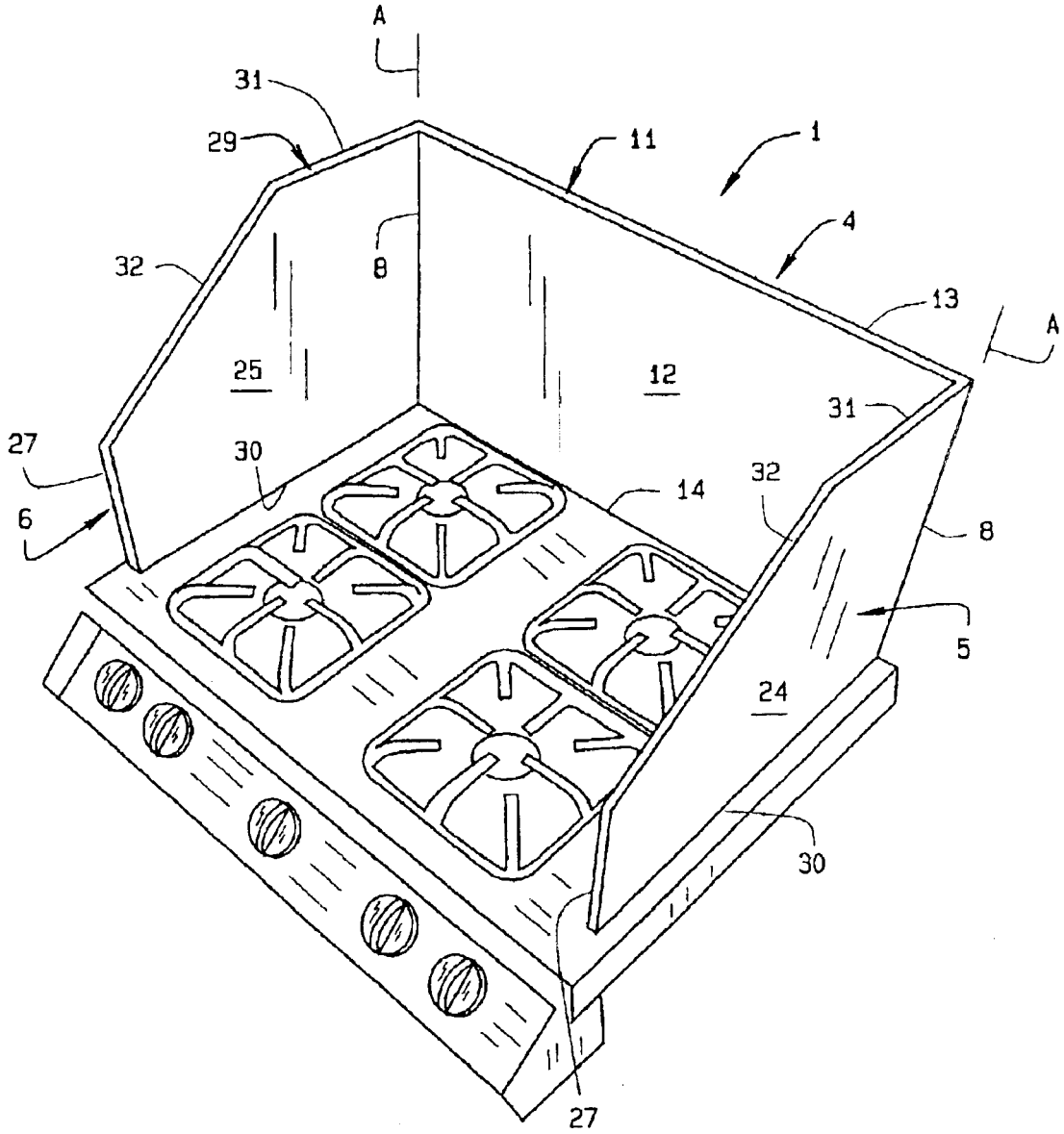
FIG. 1 is a perspective view of the present splatter shield shown in combination with a conventional stovetop.
Figure 2:
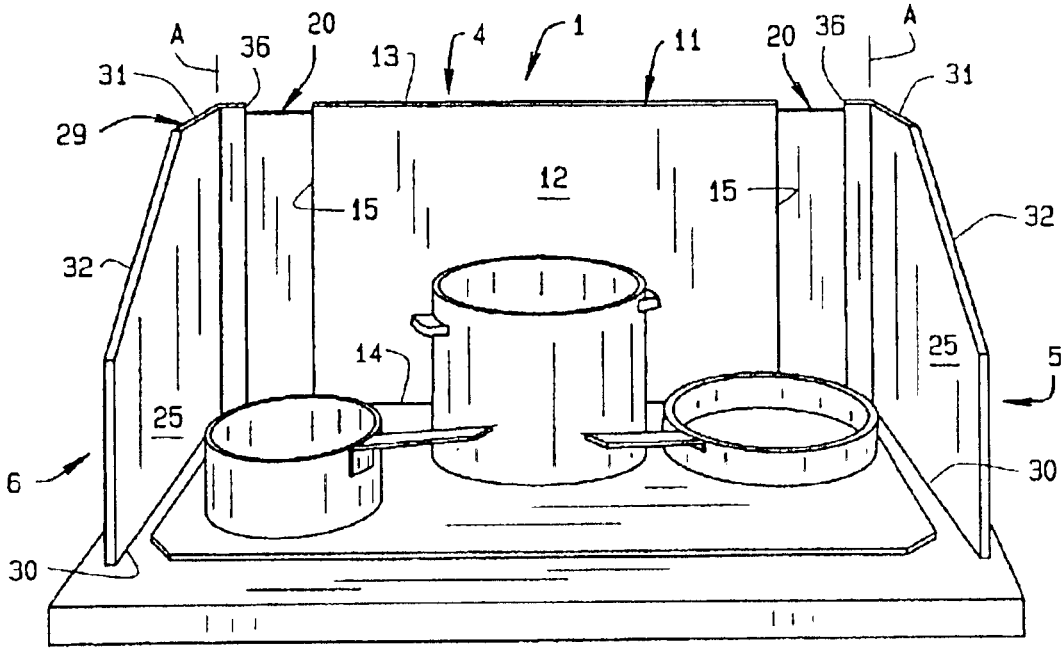
FIG. 2 is a front elevation view, in perspective, showing the present splatter shield with its adjustable end panels in an extended position.
Figure 3A:
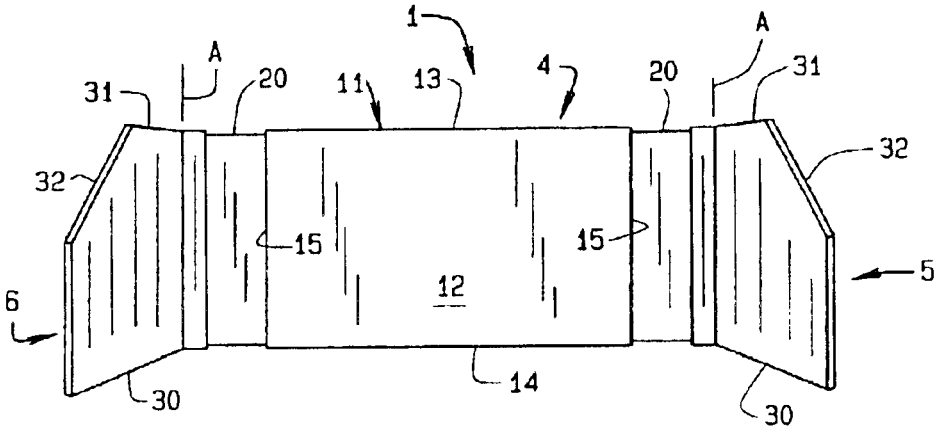
FIG. 3A is a front elevational view, in partial perspective, showing the present splatter shield in an extended position with its end panels angularly oriented with respect to the central panel.
Figure 3B:
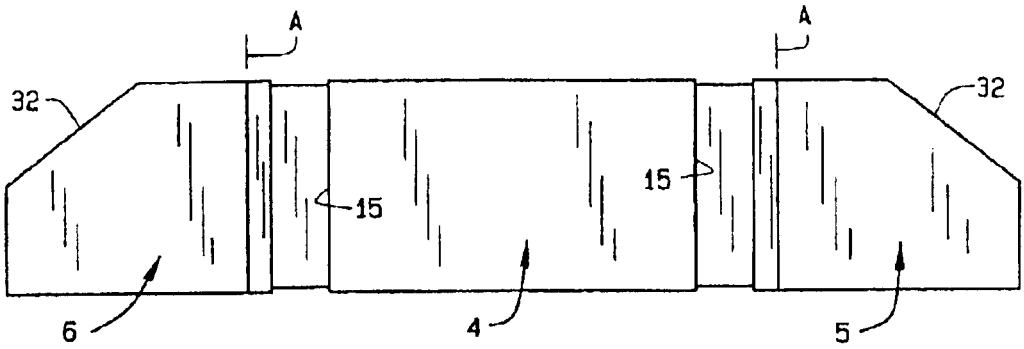
FIG. 3B is a front elevational view showing the present splatter shield in an extended position with its end panels in alignment with the central panel.
Figure 4:
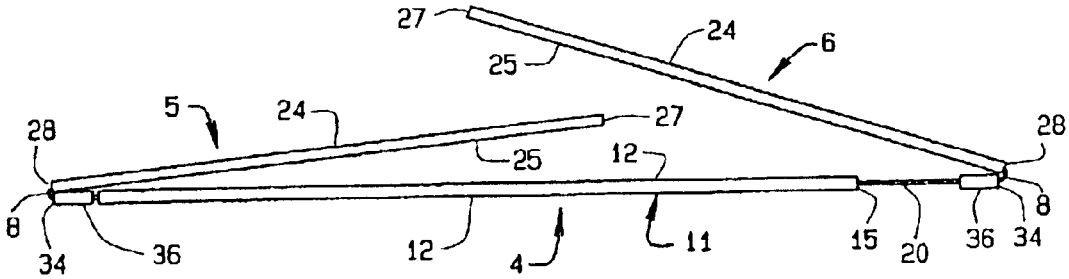
FIG. 4 is a top plan view of the present splatter shield with one of its end panels in a laterally extended position showing the connection of the end panels to the central panel.
Figure 5:
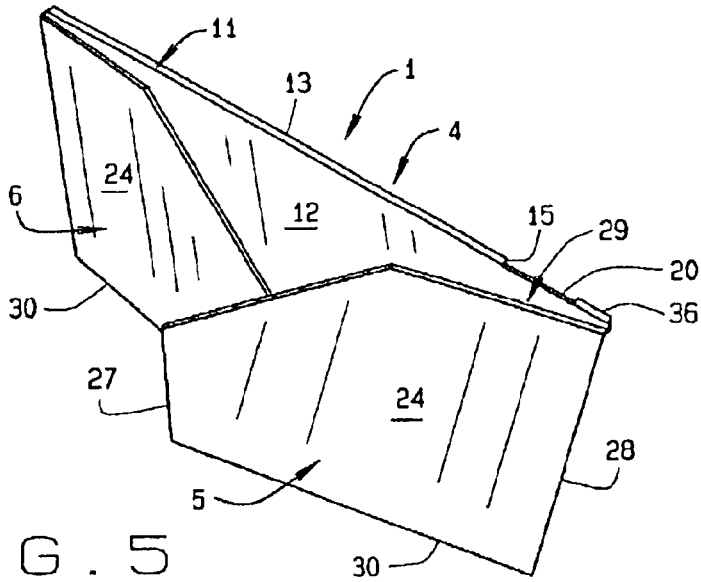
FIG. 5 is a perspective view of the present splatter shield shown in a folded or collapsed storage condition.

Referring to the drawings more particularly by reference numbers wherein like numerals refer to like parts, the reference number 1 in FIGS. 1, 2, 3A, 3B, 4–7 and 9–11 identifies one embodiment of a splatter shield constructed in accordance with the teachings of the present invention. The present splatter shield 1 can be used in a variety of locations in a freestanding mode as best illustrated in FIGS. 1 and 2 and can be stored in a collapsed or folded condition as best illustrated in FIG. 5. The splatter shield 1 includes a central panel 4 and a pair of end panels 5 and 6, all of which are preferably generally planar. The end panels 5 and 6 are hingedly connected to the central panel 4 such as by the hinge members 8. The end panels 5 and 6 are angularly movable relative to the central panel 4 about the hinge members 8 whereby the end panels 5 and 6 may be selectively positioned extending outwardly from the central panel 4 as best illustrated in FIG. 1 to provide a freestanding splatter shield 1 or in a folded condition for storage as best illustrated in FIG. 5. Because of the construction of the hinge members 8, the end panels 5 and 6 are likewise positionable at any intermediate angular orientation (FIG. 3A) between a fully collapsed or folded storage position as best shown in FIG. 5 and a fully opened position as illustrated in FIG. 3B. The hinge members 8 permit the end panels 5 and 6 to pivot about the axis A which is generally parallel to the major plane of the end panels 5 and 6 and the central panel 4 as best illustrated in FIGS. 1, 2, 3A and 3B and as described in detail below.

Figure 7:
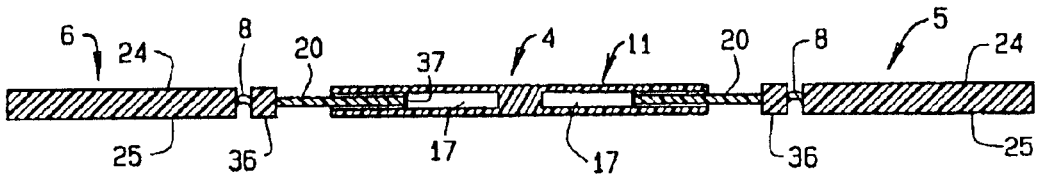
FIG. 7 is a cross-sectional view illustrating one embodiment of the central panel wall member and its associated extension members and end panels.

The central panel 4 includes a wall member 11 having generally opposite parallel and planar surfaces 12, top and bottom edges 13 and 14, and end edges 15 as best shown in FIGS. 2, 3A, 3B, 4 and 5. Preferably, the end edges 15 are generally parallel to one another. The bottom edge 14 is generally perpendicular to the end edges 15 and is adapted for resting on a supporting surface such as a countertop, stovetop, sink area and the like. The top edge 13 is shown as generally straight but may include any suitable contour including a decorative contour. As best illustrated in FIG. 7, one embodiment of the wall member 11 includes receptacles 17 which can be shaped in the form of pockets or slots each opening onto a respective end edge 15. When in the form of a slot, each receptacle 17 opens onto a respective end edge 15 and it may also open onto at least one of the top or bottom edges 13 and 14 respectively, or even both the top edge and bottom edge of the wall member 11 if so desired. The construction of the receptacles 17 are selected for facilitation of the manufacturing of the wall member 11 and it is recognized and anticipated that the receptacles 17 may take on a multitude of different shapes and configurations. Depending upon the selected configuration of the receptacles 17, the wall member 11 may be formed by an extrusion process or an injection molded process. If in the form of a pocket, the receptacle or opening 17 can be closed at the top and/or bottom edges.

The splatter shield 1 further includes extension end members 20 each movably receivable within a respective receptacle 17. Each member 20 is movable relative to the wall member 11 in a direction generally along its longitudinal length as best illustrated in FIGS. 4, 5 and 7 to extend and retract the members 20 to increase and decrease the overall length of the central panel 4. The use of the extension members 20 permits adjustment of the length of the central panel 4 to accommodate different sized work areas providing flexibility in its use.

A retention mechanism is provided to selectively retain the members 20 in position relative to the wall member 11. The retention mechanism may be in the form of friction between the interior surfaces of the receptacle or opening 17 and the exterior surfaces of the corresponding member 20 which is slidably moveable therewithin. As illustrated in another embodiment of the extension members 20 shown in FIG. 8, the retention mechanism may also include grooves or recesses 21 associated with the member 20 and corresponding protuberances or projections 22 associated with at least one interior surface of the wall member 11 forming the receptacle 17, the grooves 21 and projections 22 being inter-engageable with one another to resist longitudinal movement of the member 20 relative to the wall member 11 but still permit relative movement therebetween.

The end panels 5 and 6 are of generally the same construction and may be identical constructions if desired. A description of one end panel will provide the detail for both end panels. The panel 5 or 6 is generally planar having main planar surfaces 24 and 25 that are generally parallel to one another as best shown in FIGS. 1, 2, 4, 7 and 8. The panel 5 or 6 has opposite end edges 27 and 28 and top and bottom edges 29 and 30 respectively. The top edge 29 may have a generally horizontal run 31 and an inclined run 32 as best shown in FIGS. 1, 2, 3A and 3B. It is recognized and anticipated that the top edge 29 of each end panel 5 and 6 may take on a wide variety of different slopes or contours. The end panels 5 and 6 are each hingedly connected to the central panel 4 as by attachment with the hinge members 8. In the illustrated structure, as best seen in FIGS. 3A, 3B, 7 and 8, the end panels 5 and 6 are each respectively connected to an extension member 20 via a hinge member 8 which has one end portion connected adjacent the respective end edge 28 of the end panel 5 or 6 and has its other end portion connected to an end edge 34 of the respective extension member 20.

The hinge member 8 can be of any suitable form and is preferably integral with certain of the components of the splatter shield 1. In the illustrated structure, the hinge member 8 is a thin web of plastic material that is integral with an end panel 5 and 6 and central panel 4 as, for example, by being integral with the extension member 20. The hinge member 8 extends between the respective edges 28 and 34 and should be of sufficient strength and flexibility to withstand and endure repeated use. In addition, the hinge member 8 in the illustrated structure has sufficient width to allow the end panels 5 and 6 to fold over and lie generally parallel to one another and to the central panel 4 in an overlaying relationship to each other for storing the splatter shield 1 in a collapsed condition. It is also recognized and anticipated that other hinge constructions such as a ball and socket arrangement could likewise be utilized.

Figure 8:
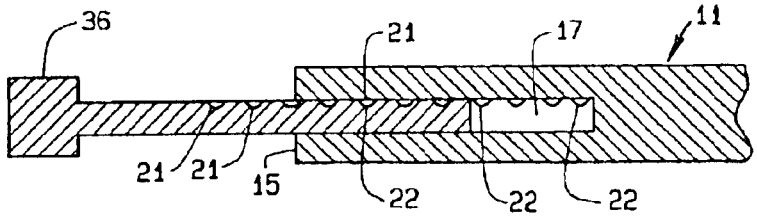
FIG. 8 is an enlarged fragmentary view illustrating another embodiment of the central panel wall member and one of its associated extension members.

In a preferred embodiment, the extension members 20 and the respective end panels 5 and 6 are formed as a monolithic structure such as via an extrusion or injection molding process. As best illustrated in FIGS. 4, 7 and 8, the extension members 20 may include a stop member 36 to limit the amount of movement of the extension member 20 into its respective receptacle 17. The stop member 36 may also extend along the height of the end panel 5 and 6 as best illustrated in FIGS. 2, 3A and 3B. In similar fashion, the opposite end of the extension member 20 which resides within the receptacle 17 may likewise include a stop member such as the stop member 37 illustrated in FIG. 7. The stop member 37 is positioned and located to either prohibit or at least hinder the complete removal of the extension member 20 from the receptacle 17 when the member 20 is moved outwardly away from the central panel 4 to increase its overall length. The stop member 37 may be a rigid member which will engage the end edges 15 of central panel 4 forming the receptacle 17 to prevent removal of the member 20 therefrom, or stop member 37 may be a rigid flexible member which will engage end edges 15 and provide resistance to completely removing member 20 from receptacle 17. Stop member 37 can likewise take on a wide variety of different sizes and shapes such as one or more beads or projections associated with one or both sides of the extension member 20 adjacent to its terminal end in order to accomplish the stated objective.

As illustrated in FIG. 5, the splatter shield 1 may be provided with a shelf member 38 which can be used optionally with the central panel 4 and end panels 5 and 6 when the shield is in a freestanding orientation. The shelf member 38 is shown as being generally planar and having a generally rectangular configuration with side edges 39 and front and rear edges 40 and 41 respectively. The end panels 5 and 6 may be provided with shelf supports that are affixed to the end panels or separatable therefrom, for example, by having projections insertable through holes in the end panels. The shelf member 38 may also be provided with legs to support the shelf member 38 above a countertop or other work area. Alternately, the shelf member 38 may just be a planar sheet of material such as a conventional cutting board wherein one of its main surfaces 42 or 43 simply rests upon a countertop, or on the burners of a stove as illustrated in FIG. 6.

Figure 6:
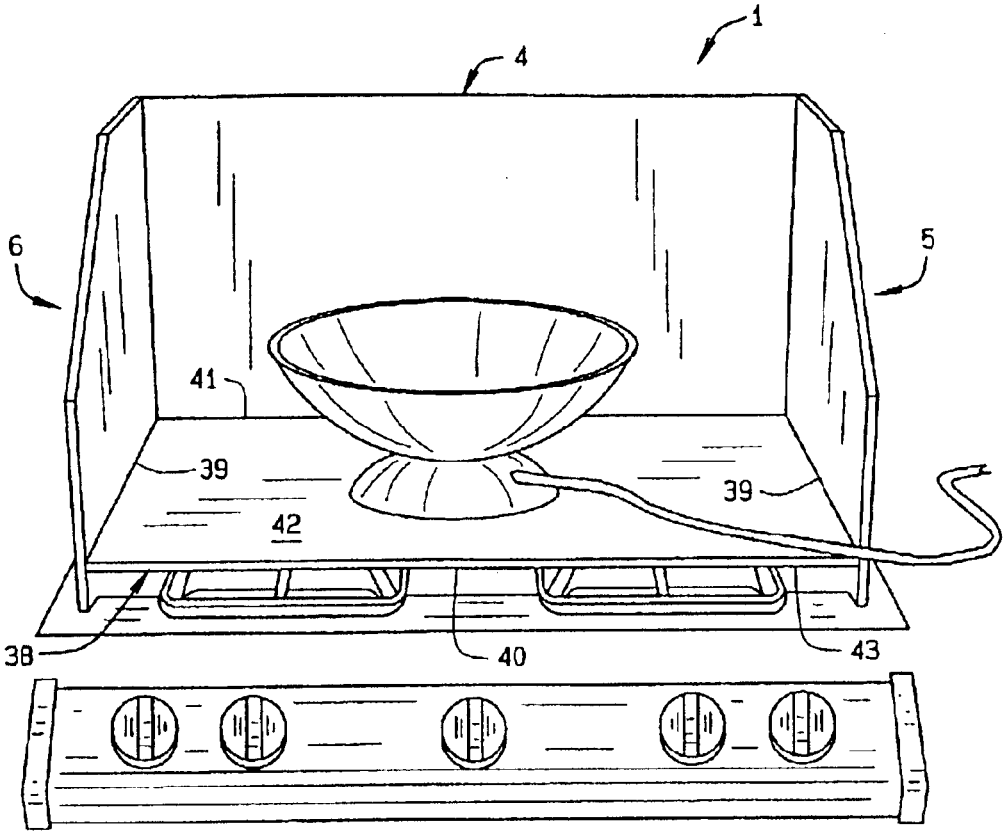
FIG. 6 is a perspective view of the present splatter shield with an optional shelf member.

As illustrated in FIG. 6, the present splatter shield 1 in association with the shelf member 38 is illustrated in operative use with an electric appliance such as a wok. The shelf member 38 is positioned on top of the conventional burners associated with a typical gas stove or electric range and the wok is positioned on upper surface 42 thereof. It is also recognized and anticipated that the shelf member or cutting board 38 could be positioned on a conventional countertop or other work area with the splatter shield 1 positioned therearound and the wok or other electrical appliance could be used in conjunction therewith.

Figure 9:
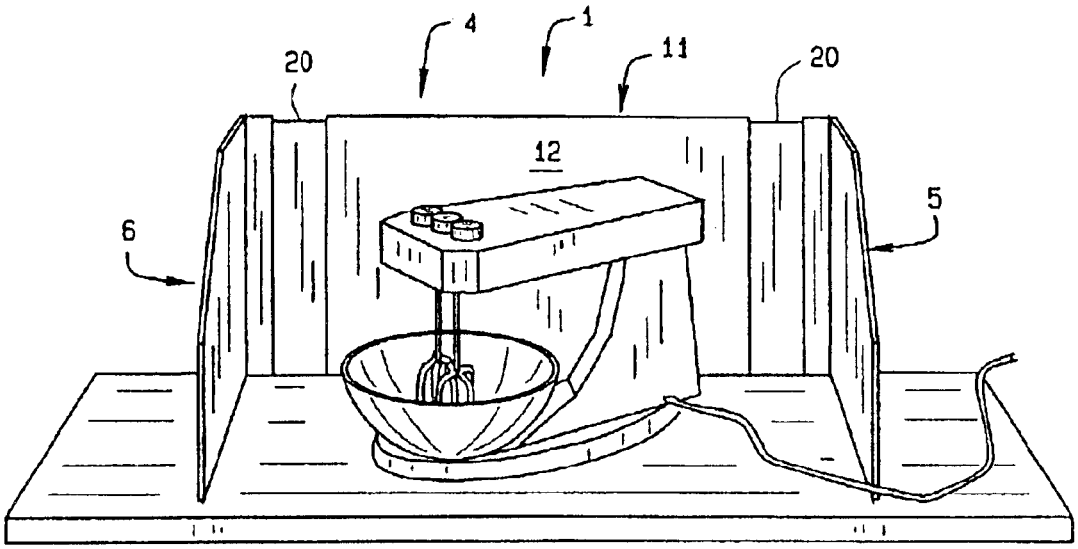
FIG. 9 is a front perspective view illustrating use of the present splatter shield on a countertop with an electric appliance.

As best illustrated in FIG. 9, the present splatter shield 1 can likewise be utilized on a conventional countertop without using the shelf member 38 and a typical electrical appliance such as the mixer illustrated in FIG. 9 can be positioned between end panels 5 and 6 and central panel 4 to prevent the contents within the mixing bowl from splattering outside the confines of splatter shield 1.

Figure 10:
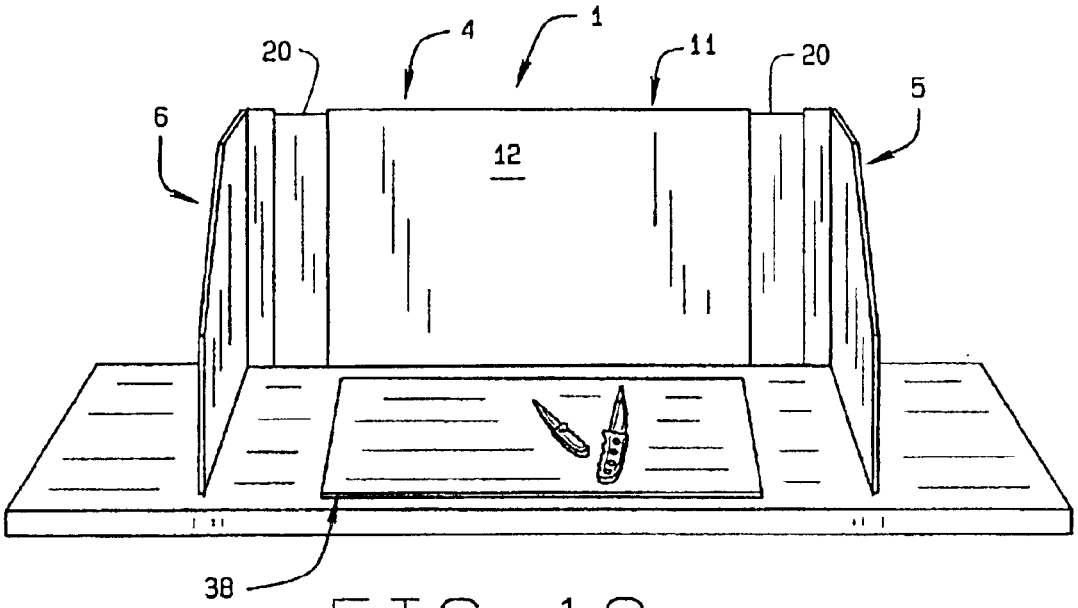
FIG. 10 is a front perspective view illustrating use of the present splatter shield on a countertop with a cutting board.

In similar fashion, as illustrated in FIG. 10, the splatter shield 1 can likewise be utilized in association with a conventional cutting board, or shelf member 38, to again prevent the splatter of food being prepared on the cutting board or shelf member 38.

It is also important to recognize that the present splatter shield 1 can be utilized without extension members 20, in which case the central panel 4 would not be adjustable lengthwise, but end panels 5 and 6 would still be selectively angularly positionable at a plurality of different angular orientations relative to the central panel 4 between a first storage position wherein the panel members 5 and 6 would lie substantially parallel to the central panel 4 in an overlaying relationship thereto and a second operative position which is angularly oriented relative to the storage position. It is also recognized and anticipated that only one end portion of the central panel 4 may include the receptacle 17 for housing only one extension member 20. In this particular embodiment, one end portion of the central panel 4 would be adjustable to increase or decrease the overall length of the panel 4 whereas the opposite end portion of central panel 4 would be hingedly or pivotally attached to a non-extendable end panel. Still further, it is contemplated that the expandable or adjustable portion of the central panel could be housed intermediate the two opposite end portions thereof. In this particular arrangement, the central panel 4 would be divided into two separate pieces each including a receptacle or opening adaptable for receiving a centrally positioned extension member wherein the two separate pieces forming the central panel would be selectively moveable relative to the central extension member to increase and decrease the overall length of the central panel. In this case, the end panels 5 and 6 would be pivotally or hingedly attached to the outside end portions of each central panel portion. Still other configurations and arrangements for adjustably changing the overall length of central panel 4 are anticipated and recognized.

Figure 11:
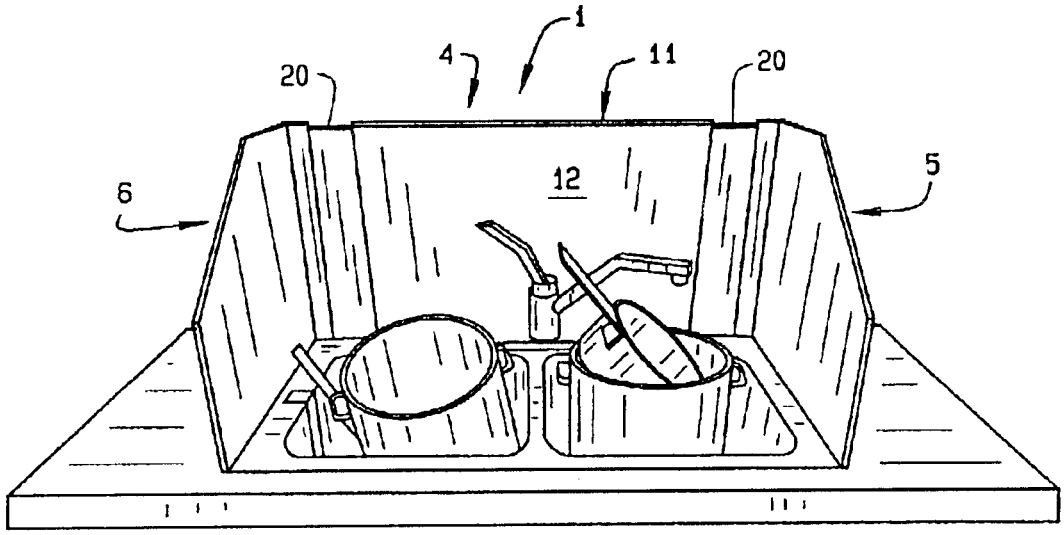
FIG. 11 is a front perspective view illustrating use of the present splatter shield in association with a conventional sink area.

Still further, FIG. 11 illustrates use of the present splatter shield 1 in association with a typical sink area so as to again prevent the splatter of food, soap and/or water during the cleaning process. Other uses of the present splatter shield 1 in and around a typical sink area are likewise envisioned such as preparing and cleaning food in the sink area.

The present splatter shield 1 including central panel 4 and end panels 5 and 6 are preferably molded of a polymeric material such as polypropylene, polyethylene, or the like. Regardless of the specific type of material, it is preferred that the material utilized be flame and heat resistant. It is also preferred that the panels 4, 5 and 6 be non-porous and non-absorbent so as to be odor resistant and that such panels be made of a material having a stick-free surface. Still further, it is preferred that the material forming panels 4, 5 and 6 be bacteria resistant or that such materials can be treated so as to be bacteria resistant. It is also preferred that the material forming the present splatter shield 1 be lightweight and that such material cleans easily with soap and water. It is also anticipated that the present splatter shield 1 can be provided in a variety of different colors and textures to accommodate the motif and d é cor associated with kitchens and cooking areas in all environments.

It is also recognized that the present splatter shield 1, when used in conjunction with a gas or electric stove positioned or located within a center island or other island or countertop location within a kitchen, serves as an additional safety device since it prevents hot food, grease, oil or other cooking items from splattering into an open area behind the island stove, which hot splatter may injure passing or standing individuals or may cause damage to the surrounding furniture or floor coverings. Still further, when a venting system is in use or associated with a particular stove arrangement, the present splatter shield 1 also facilitates heat exchange from the stove to the venting system and helps keep the stove area cooler. Other advantages and benefits from using the present splatter shield 1 are envisioned and can be obtained from a study of the present disclosure.

As is evident from the foregoing description, certain aspects of the present invention are not limited by the particular details of the examples illustrated herein and it is therefore contemplated that a wide variety of other applications and uses of the present splatter shield will occur to those skilled in the art.

Thus, there has been shown and described a novel freestanding splatter shield which fulfills all of the objects and advantages sought therefor. Many changes, modifications, variations and other uses and applications of the present splatter shield, or equivalents thereof, will become apparent to those skilled in the art after considering this specification and the accompanying drawings. All such changes, modifications, variations, and other uses and applications which do not depart from the spirit and scope of the present invention are deemed to be covered by the invention which is limited only by the claims which follow.

What is claimed is:

1. A freestanding splatter shield for use in kitchens and other work areas comprising:

a central panel having a top, bottom and opposite first and second ends, said central panel including a wall member and at least one extension member operably associated with said wall member, said at least one extension member being selectively moveable relative to said wall member for selectively increasing and decreasing the length of said central panel;

said wall member including a slot opening adjacent to at least one end portion of said wall member for receiving said first extension member therein, said first extension member being selectively moveable within said slot relative to said wall member;

a first end panel pivotally attached to said central panel and extending therefrom adjacent the first end of said central panel for movement about an axis generally parallel to said first end;

a second end panel pivotally attached to said central panel and extending therefrom adjacent the second end of said central panel for movement about an axis generally parallel to said second end;

said first and second end panels being selectively positionable at a plurality of different angular orientations relative to said central panel to selectively accommodate different work areas; and a retention mechanism cooperating with said wall member and with said first extension member for selectively retaining said first extension member in a selected position relative to said wall member, said retention mechanism including a plurality of recesses in one of said first extension member and said wall member which are engageable with a plurality of protuberances in the other of said first extension member and said wall member.

2. The splatter shield as set forth in claim 1 wherein said at least one extension member is positioned adjacent one of said first and second ends of said central panel and has one end portion thereof attached to either said first or second end panel.

3. The splatter shield as set forth in claim 1 including a hinge member between each of said first and second end panels and said central panel, each of said hinge members having a portion integral with a respective end panel.

4. The splatter shield as set forth in claim 3 wherein each of said hinge members has a portion integral with said central panel.

5. The splatter shield as set forth in claim 1 including a second extension member operably associated with said wall member and selectively moveable relative to said wall member for selectively increasing and decreasing the length of said central panel.

6. The splatter shield as set forth in claim 1 wherein said central panel, said at least one extension member, and said first and second end panels are made of a polymeric material.

7. A splatter shield for use in kitchens and other work areas comprising:

a central panel having opposite end portions, said central panel having at least one receptacle positioned adjacent one end portion thereof;

at least one extension member slidably receivable within said at least one receptacle, said at least one extension member being selectively moveable within said at least one receptacle relative to said central panel for selectively increasing and decreasing the length of said central panel;

a first end panel hingedly attached to one end portion of said at least one extension member and extending adjacent therefrom for pivotal movement about an axis generally parallel to said one end portion of said at least one extension member, said first end panel being pivotally moveable between a first storage position wherein said first end panel lies substantially parallel to said central panel in overlaying relationship thereto and a second operative position angularly oriented relative to said first storage position;

a second end panel hingedly attached to the opposite end portion of said central panel and extending adjacent therefrom, said second end panel being pivotally moveable between a first storage position wherein said second panel lies substantially parallel to said central panel in overlaying relationship thereto and a second operative position angularly oriented relative to said first storage position;

said first and second end panels being selectively positionable at a plurality of different angular orientations relative to said central panel to selectively accommodate different work areas.

8. The splatter shield as set forth in claim 7 wherein said central panel includes a second receptacle adjacent the opposite end portion thereof, said second receptacle being adaptable for receiving a second extension member, said second extension member being selectively moveable within said second receptacle relative to said central panel for selectively increasing and decreasing the length of said central panel, said second end panel being hingedly attached to one end portion of said second extension member and extending adjacent therefrom for pivotal movement about an axis generally parallel to said one end portion of said second extension member.

9. The splatter shield as set forth in claim 7 wherein said first end panel is hingedly attached to said first extension member via a hinge member, said hinge member being integrally formed with said first end panel and with said first extension member.

10. The splatter shield as set forth in claim 7 wherein said at least one extension member includes a stop member for limiting the amount of movement of said at least one extension member into said at least one receptacle when decreasing the length of said central panel.

11. The splatter shield as set forth in claim 7 wherein said at least one extension member includes a stop member for limiting the amount of movement of said at least one extension member out of said at least one receptacle for increasing the length of said central panel.

12. The splatter shield as set forth in claim 7 including a shelf member positionable within the work area formed by and between said central panel and said first and second end panels.

13. A splatter shield for use in kitchens and other work areas comprising:

a central panel including a wall member having opposite end portions, said wall member having a first receptacle positioned adjacent one end portion thereof and a second receptacle positioned adjacent the opposite end portion thereof;

a first extension member slidably receivable and selectively moveable within said first receptacle for selectively increasing and decreasing the length of said central panel;

a first end panel pivotally attached to one end portion of said first extension member and extending adjacent therefrom for pivotal movement about said one end portion of said first extension member, said first end panel being pivotally moveable between a first storage position and a second operative position angularly related thereto;

a second extension member slidably receivable and selectively moveable within said second receptacle for selectively increasing and decreasing the length of said central panel;

a second end panel pivotally attached to one end portion of said second extension member and extending adjacent therefrom for pivotal movement about said one end portion of said second extension member, said second end panel being pivotally moveable between a first storage position and a second operative position angularly related thereto.

14. The splatter shield as set forth in claim 13 including a retention mechanism cooperating with said wall member and with said first and second extension members for selectively retaining said first and second extension members in a selected position relative to said wall member.

15. The splatter shield as set forth in claim 14 wherein said retention mechanism includes frictional engagement between said wall member and said first and second extension members.

16. The splatter shield as set forth in claim 13 wherein said central panel, said first and second extension members, and said first and second end panels are made of a polymeric material.

17. The splatter shield as set forth in claim 13 including a first stop member associated with said first and second extension members for limiting the amount of movement of said first and second extension members into said first and second receptacles when decreasing the length of said central panel.

18. The splatter shield as set forth in claim 13 including a second stop member associated with said first and second extension members for limiting the amount of movement of said first and second extension members out of said first and second receptacles for increasing the length of said central panel.

* * * * *